US005563389A

United States Patent [19]

Marin et al.

[11] Patent Number: 5,563,389

[45] Date of Patent: Oct. 8, 1996

[54] HIGH-VOLTAGE POWER SWITCH

[75] Inventors: Heiner Marin; Volker Lehmann, both of Berlin, Germany

[73] Assignee: Siemens Aktiengesellschaft

[21] Appl. No.: 313,088

[22] PCT Filed: Mar. 26, 1993

[86] PCT No.: PCT/DE93/00308

§ 371 Date: Apr. 11, 1995

§ 102(e) Date: Apr. 11, 1995

[87] PCT Pub. No.: WO93/20574

PCT Pub. Date: Oct. 14, 1993

[30] Foreign Application Priority Data

Mar. 31, 1992 [DE] Germany ..... 42 11 158.7

[51] Int. Cl.[6] ..... H01H 33/88

[52] U.S. Cl. ..... 218/62; 218/65; 218/50

[58] Field of Search ..... 218/43, 46, 47, 218/51, 53, 57, 59, 60, 61, 62, 63, 64, 65, 68, 72, 73, 74, 50

[56] References Cited

U.S. PATENT DOCUMENTS 4,434,336 2/1984 Garzon ..... 200/150

4,511,775 4/1985 Korner et al. ..... 200/148 A 4,565,911 1/1986 Slamecka ..... 200/148

FOREIGN PATENT DOCUMENTS 2575323 6/1986 France .

*Primary Examiner*—Brian W. Brown

*Assistant Examiner*—Michael A. Friedhofer

*Attorney, Agent, or Firm*—Kenyon & Kenyon

[57] ABSTRACT

High-voltage power switch with an arc contact and a spatially separated rated current contact, with the movable part of the rated current contact taking the form of an external hollow cylinder for delimiting a storage space for a pressurized quenching gas. The hollow cylinder is made of a one-piece precision casting of contact material, especially CuCr alloy, the jacket of which is stiffened by three inwardly projecting flange-like projections. This design provides a light structure for a bridging circuit component for a rated current contact requiring comparatively little driving power for its operation.

6 Claims, 1 Drawing Sheet

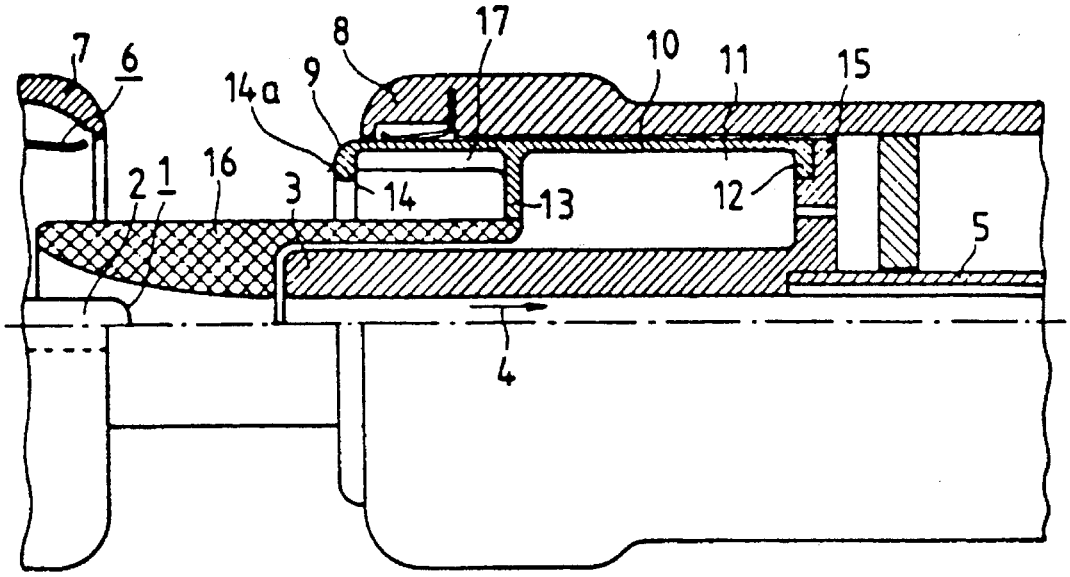
7
6
8
17
10
11
15
14a
9
2
1
16
3
14
13
12
5
4

HIGH-VOLTAGE POWER SWITCH

BACKGROUND OF THE INVENTION

The present invention concerns a high-voltage power switch with an arc contact and a separate rated current contact, the moving part of which takes the form of an external hollow cylinder to delimit a storage space for a pressurized quenching gas.

For high-voltage power switches it is common that an electric arc, formed during switching off, is drawn via an arc contact, while the rated currents are conducted by a separate rated current contact. When such a high-voltage power switch must blow quenching gas such as sulfur hexafluoride into the separating gap, the rated current contact may, at least partially, form a storage space that is required for storing the pressurized quenching gas. The storage space proper can be pressurized via the are and/or designed as a movable part of a compressor means for a quenching gas.

In all cases, the rated current contact can be moved by the drive mechanism of the high-voltage power switch and must be kept light in weight in order to keep the required driving power low.

SUMMARY OF THE INVENTION

A rated current contact for a high-voltage power switch of the aforementioned type can be designed to be lightweight according to the present invention by constructing the hollow cylinder from a one-piece precision casting made of contact material, the jacket of which is stiffened by three inwardly projecting flange-like projections.

By using the present invention, the cylinder jacket can be made thin-walled, since the deforming forces acting upon the cylinder jacket at the pressures present cause no deformation of the jacket surface thanks to the stiffening projections.

In an advantageous embodiment of a high-voltage power switch according to the invention, the first flange-like projection is formed as an attachment flange for coupling to the reciprocatingly movable drive mechanism. It can be advantageous if the second, middle projection is provided for attaching an insulating material nozzle traversed by the arc contact and for forming a bottom of a storage space for supplying the insulating nozzle. Furthermore, it has proved advantageous that the third projection, forming the free front end, be built as an electrode for evening out the electric field between the open contacts.

When high pressures are expected in the storage space, it is advantageous if the cylinder jacket is provided with internal stiffening strips, which also conduct rated current and run basically parallel to the cylinder generatrix between the second and third projections.

In a preferred embodiment of the high-voltage power switch according to the invention, the second projection is formed so that it protrudes farthest into the hollow cylinder in relation to the two other projections.

In all embodiments, a CuCr alloy is provided as contact material for reasons of availability.

BRIEF DESCRIPTION OF THE DRAWINGS

An embodiment of a high-voltage power switch is described and its operation explained using the drawing.

The lone figure shows the partial section of a high-voltage power switch, where only the parts required for understanding the present invention are illustrated, without the outer boundary of the switch chamber and without the drive, which is at ground potential.

DETAILED DESCRIPTION

The high-voltage power switch according to the present invention has an arc contact 1 consisting of a fixed arc switching component 2 and a movable arc switching component 3, between which an arc is drawn during switch-off. For this purpose, movable arc switching component 3 is moved in the direction of arrow 4 by a drive mechanism 5. Spatially separated from this arc contact 1 there is provided a rated current contact 6, which has two fixed switching components 7 and 8 and a movable bridging circuit component 9. This bridging circuit component 9 is made of a CuCr alloy and is designed as a one-piece precision casting. As the figure shows, bridging circuit component 9 has basically the shape of a hollow cylinder, jacket 10 of which delimits a storage space 11 for a pressurized quenching gas, for example, sulfur hexafluoride. Cylinder jacket 10 has three inwardly projecting flange-like projections 12, 13 and 14, which stiffen the thin-walled and lightweight construction of the hollow cylinder.

The first flange-like projection 12 is designed as an attaching flange and can be removably connected to a collar-like supporting element 15, located on drive mechanism 5. Thus bridging circuit component 9 is reciprocatingly movable by the drive and coupled with movable arc switching component 3.

The second, middle projection 13 is designed for attachment to a nozzle 16 made of insulating material, surrounding arc contact 1 and extending from the storage space. As the figure shows, projection 13 forms a bottom for storage space 11.

The third projection 14, which forms free front end **14*a* of bridging circuit component 9 is designed as an electrode, which evens out the electric field between open contacts 1 and 6. Between second projection 13 and third projection 14, cylinder jacket 10 is provided with cast-on stiffening strips 17 running parallel to the cylinder generatrix and evenly distributed over the inner surface of the hollow cylinder. These stiffening strips 17 prevent deformation of the thin-walled hollow cylinder at higher pressures in storage space 11. They can also prevent projection 13** from warping.

As shown in the figure, middle projection 13 is designed so that it protrudes into the hollow cylinder further than the other projections 12 and 14. This design advantageously facilitates assembly.

What is claimed is:

1. A high-voltage power switch comprising:

an arc contact; and a separate current contact surrounding the arc contact and including a movable element with a generally cylindrical body containing an annular storage space for a pressurized quenching gas, wherein:

said movable element includes a generally cylindrical jacket with first, second and third flange-like projections projecting inwardly, the jacket being formed as a one-piece casting including contact material, said movable element includes an arc switching component for contacting the arc contact when the movable element is in an extended position, the jacket being arranged concentrically with the arc switching component about an axis of the movable elements said storage space is bordered by the jacket and the arc switching component and the first and second flange-like projections, and said second flange-like projection is positioned between the first and third flange-like projections and is attached to a nozzle comprised of insulating material traversing the arc contact.

2. The high-voltage power switch of claim 1; wherein said first flange-like projection includes an attachment portion for coupling to a reciprocatingly movable drive mechanism.

3. The high-voltage power switch according to claim 1, wherein said third flange-like projection forms a rim about an opening in a first end of the generally cylindrical jacket and is formed as an electrode for evening out an electric field between the arc contact and the separate current contact.

4. The high-voltage power switch of claim 1, wherein the jacket includes internal stiffening strips between the second and third flange-like projections, the stiffening strips being substantially parallel to the axis of the movable element.

5. The high-voltage power switch of claim 1 wherein said second flange-like projection protrudes further inward than the first and third flange-like projections.

6. The high-voltage power switch of claim 1, wherein said contact material includes a CuCr alloy.

* * * * *